US010233676B2

(12) United States Patent
Lin

(10) Patent No.: US 10,233,676 B2
(45) Date of Patent: Mar. 19, 2019

(54) CONNECTION LOCK

(71) Applicant: LINTEX CO., LTD., Zhanghua County (TW)

(72) Inventor: Chia-Sheng Lin, Zhanghua County (TW)

(73) Assignee: LINTEX CO., LTD, Zhanghua County (TW)

( * ) Notice: Subject to any disclaimer, the term of this patent is extended or adjusted under 35 U.S.C. 154(b) by 0 days.

(21) Appl. No.: 15/859,975

(22) Filed: Jan. 2, 2018

(65) Prior Publication Data

US 2018/0209179 A1 Jul. 26, 2018

(30) Foreign Application Priority Data

Jan. 26, 2017 (TW) ..... 106201629 U

(51) Int. Cl.
*E05B 73/00* (2006.01)

(52) U.S. Cl.
CPC ..... *E05B 73/0082* (2013.01); *E05B 73/0005* (2013.01)

(58) Field of Classification Search
CPC .. E05B 73/0005; E05B 73/00; E05B 73/0082; E05B 73/0029; E05B 53/003; E05B 53/005; Y10T 70/5009
USPC ..... 70/58, 256, 257; 248/551–553; 292/28, 292/38, 50, 84, 125, 133, 141, 171, 225, 292/235; 361/679.57, 679.58
See application file for complete search history.

(56) References Cited

U.S. PATENT DOCUMENTS 3,910,081 A * 10/1975 Pender ..... B62H 5/003 70/233
4,796,929 A * 1/1989 Gergoe ..... E05B 79/20 292/28
7,234,326 B1 * 6/2007 Lu ..... E05B 73/0005 70/14
7,626,500 B2 * 12/2009 Belden, Jr. ..... E05B 45/005 340/568.1
8,534,676 B2 * 9/2013 Whisenand ..... B60R 25/00 269/63
8,842,422 B2 * 9/2014 Hung ..... E05B 73/0005 361/679.01
9,062,476 B2 * 6/2015 Kao ..... E05B 73/00
10,066,423 B2 * 9/2018 Kao ..... E05B 73/00
(Continued)

*Primary Examiner* — Lloyd A Gall
(74) *Attorney, Agent, or Firm* — Muncy, Geissler, Olds & Lowe, P.C.

(57) ABSTRACT

A connection lock includes an adapting assembly including an outer sleeve and an adapting member, a first connecting member including a first outer tube and a first cable, a lock structure connected to the first cable, second connecting members each including a second outer tube and a second cable, and engaging structures for anti-thefting of a 3C product. The first outer tube is connected with the outer sleeve, and the first cable is connected to the adapting member. The lock structure is movable to a locked position or an unlocked position. Each second outer tube is connected with the outer sleeve, and each second cable is connected to the adapting member. Each engaging structure is connected to one said second cable and movable between an engaged position and a released position so that each engaging structure, the adapting member and the lock structure are comovable.

12 Claims, 7 Drawing Sheets

(56) References Cited

U.S. PATENT DOCUMENTS

2005/0235710 A1* 10/2005 Ling ..... E05B 73/0082
70/58
2008/0053168 A1* 3/2008 Lu ..... E05B 73/0005
70/58
2009/0189765 A1* 7/2009 Lev ..... E05B 45/005
340/568.2

* cited by examiner

CONNECTION LOCK

BACKGROUND OF THE INVENTION

Field of the Invention

The present invention relates to a connection lock for a 3C product.

Description of the Prior Art

In the modern society, the living quality is improving, and people lead a fast-paced life, so people have great demand for getting information instantly. Portable 3C products like laptops play an important role in everyday life and workplace, but this type of 3C products may be easily stolen because they are valuable, light and portable. Laptops for exhibition in 3C markets or laptops brought to cafes by customers may be easily stolen when the salesperson or the customer pay no attention to the laptops. In addition to the cost of the laptop, it would be even worse if there is important information in the laptop. To prevent a laptop from being stolen, an anti-theft chain for a laptop is provided, one of two ends thereof has an inserting member for being inserted in an anti-theft hole of a laptop, and the other of the two ends thereof has a lock, and a user can control the lock to adjust an opening range of the inserting member so that the inserting member can be fixed in the anti-theft hole to provide an anti-theft effect.

However, laptops for exhibition in 3C markets are great in number, and if the user wants to assemble an anti-theft lock on every laptop, there will be cables everywhere and not pleasant to the eye. In addition, if the user wants to assemble or disassemble the anti-theft locks, s/he has to lock or unlock the anti-theft locks respectively. The locking and unlocking processes would be complicated and need improvement.

The present invention has arisen to mitigate and/or obviate the afore-described disadvantages.

SUMMARY OF THE INVENTION

The major object of the present invention is to provide a connection lock, which corresponds to a plurality of 3C products to lock or unlock the 3C products, and the connection lock has a simple structure and is easy to be operated.

To achieve the above and other objects, a connection lock is provided, including an adapting assembly, a first connecting member, a lock structure, at least two second connecting members and at least two engaging structures. The adapting assembly defines a first direction and a second direction which is opposite to the first direction, and the adapting assembly includes an outer sleeve and an adapting member which is slidably arranged in the outer sleeve. The first connecting member includes a first outer tube and a first cable which is slidably disposed through the first outer tube, one of two ends of the first outer tube is disposed to one of two ends of the outer sleeve along the first direction, and one of two ends of the first cable is connected to one of two ends of the adapting member along the first direction. The lock structure is connected to another one of the two ends of the first cable opposite to the adapting member so that the adapting member is comovable with the lock structure, when the lock structure moves toward one of the first direction and the second direction, the lock structure is on a locked position; and when the lock structure moves toward the other of the first direction and the second direction, the lock structure is on an unlocked position. Each said second connecting member includes a second outer tube and a second cable which is slidably disposed through the second outer tube, one of two ends of each said second outer tube is disposed to one of the two ends of the outer sleeve along the second direction, and one of two ends of each said second cable is connected to one of the two ends of the adapting member along the second direction. Each said engaging structure is connected to one of the two ends of one said second cable along the second direction and movable between an engaged position and a released position so that each said engaging structure, the adapting member and the lock structure are comovable, and each said engaging structure is for being inserted in an anti-theft hole of a 3C product. When the lock structure moves toward one of the first direction and the second direction, each said engaging structure is movable to be the engaged position or the released position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
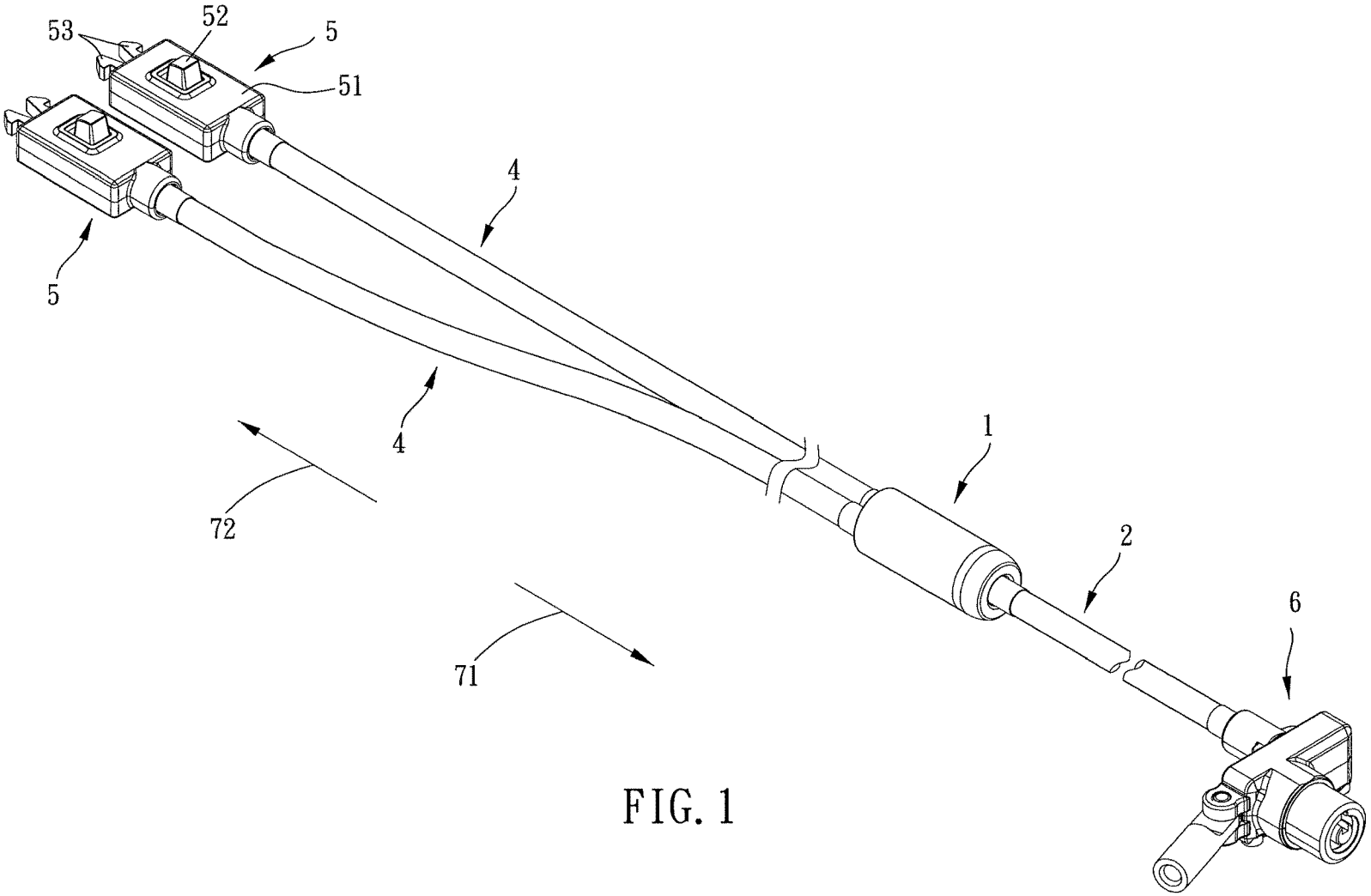
FIG. 1 is a stereogram of a preferred embodiment of the present invention.
Figure 2:
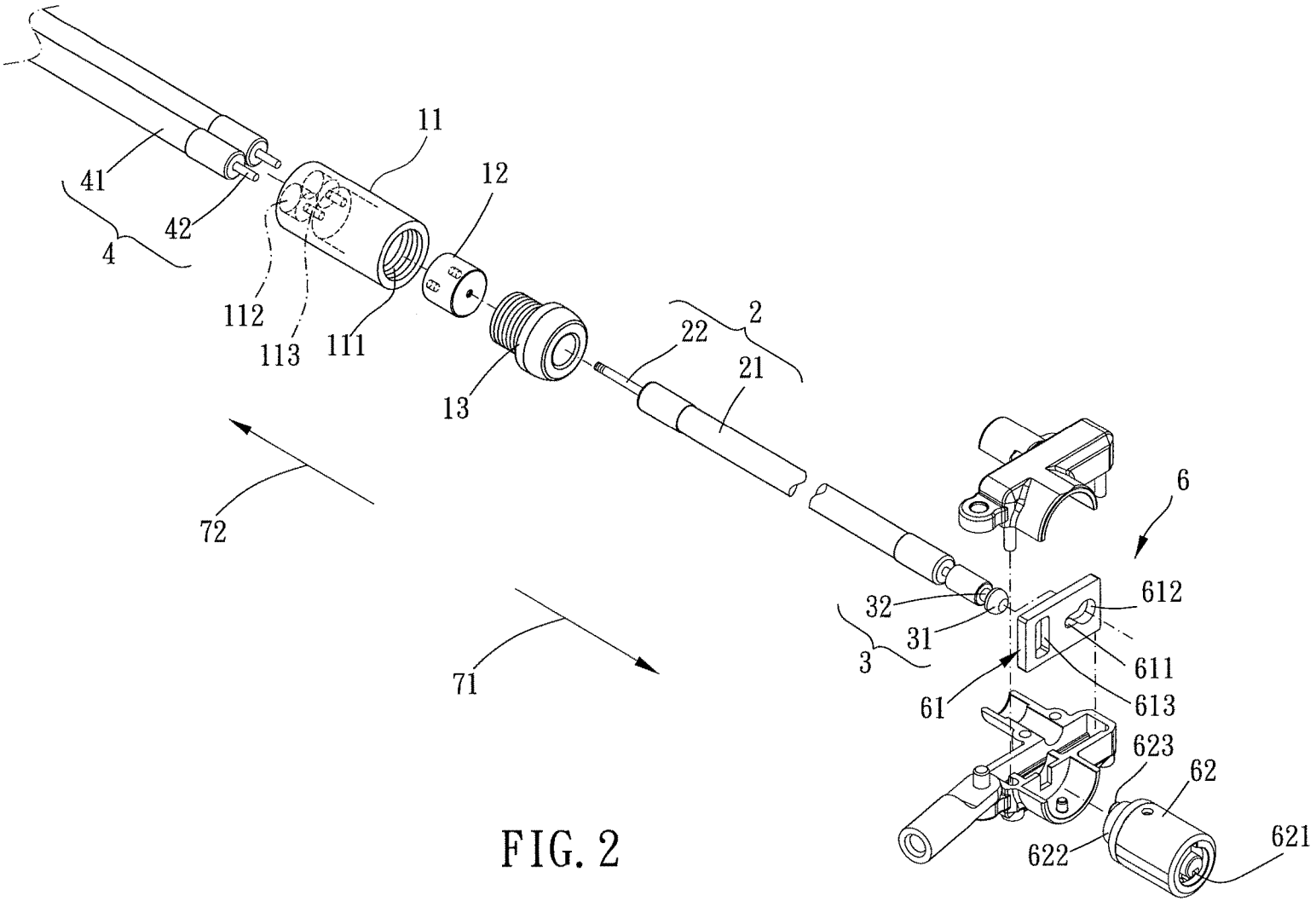
FIG. 2 is a partial breakdown view of the preferred embodiment of the present invention.
Figure 3:
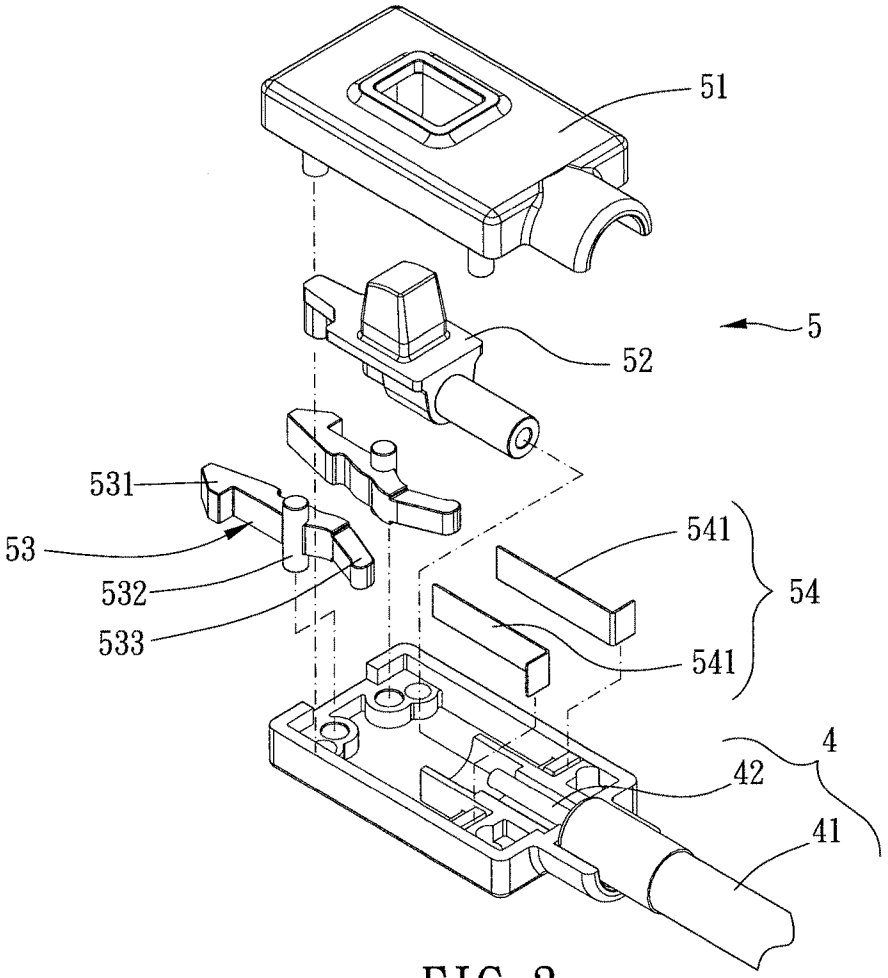
FIG. 3 is another partial breakdown view of the preferred embodiment of the present invention.
Figure 4:
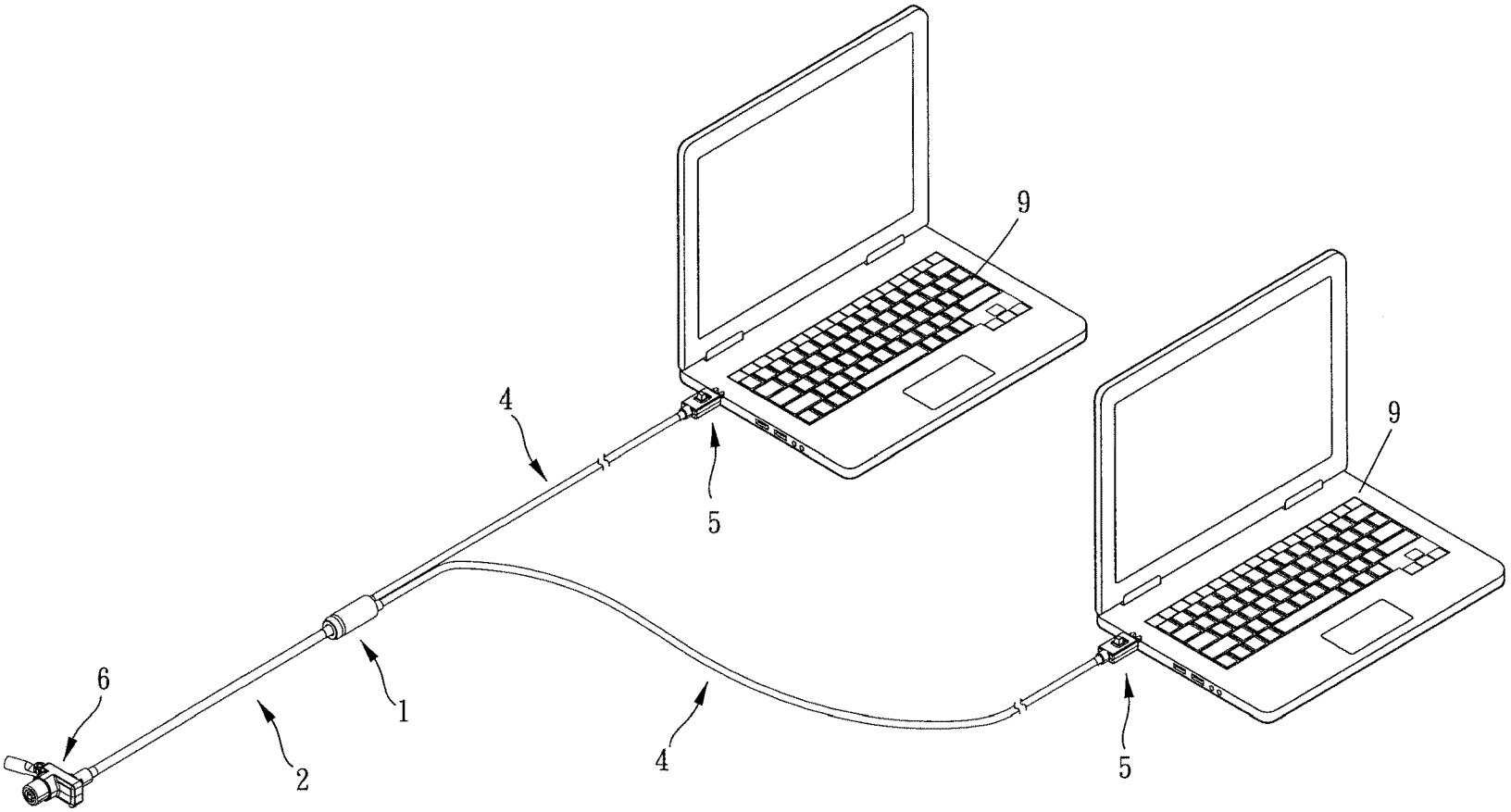
FIG. 4 is an assembly view of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 4 for a preferred embodiment of the present invention. A connection lock includes an adapting assembly 1, a first connecting member 2, a lock structure 3, at least two second connecting members 4 and at least two engaging structures 5.

The adapting assembly 1 defines a first direction 71 and a second direction 72 which is opposite to the first direction 71, and the adapting assembly 1 includes an outer sleeve 11 and an adapting member 12 which is slidably arranged in the outer sleeve 11.

The first connecting member 2 includes a first outer tube 21 and a first cable 22 which is slidably disposed through the first outer tube 21, one of two ends of the first outer tube 21 is disposed to one of two ends of the outer sleeve 11 along the first direction 71, and one of two ends of the first cable 22 is connected to one of two ends of the adapting member 12 along the first direction 71.

The lock structure 3 is connected to another one of the two ends of the first cable 22 opposite to the adapting member 12 so that the adapting member 12 is comovable with the lock structure 3, when the lock structure 3 moves toward one of the first direction 71 and the second direction 72, the lock structure 3 is on a locked position; and when the lock structure 3 moves toward the other of the first direction 71 and the second direction 72, the lock structure 3 is on an unlocked position. In this embodiment, when the lock structure moves toward the first direction 71, the lock structure 3 is on the locked position, and when the lock structure moves toward the second direction 72, the lock structure 3 is on the unlocked position; but in other embodiments, directions of the locked position and the unlocked position may interchange.

Figure 7:
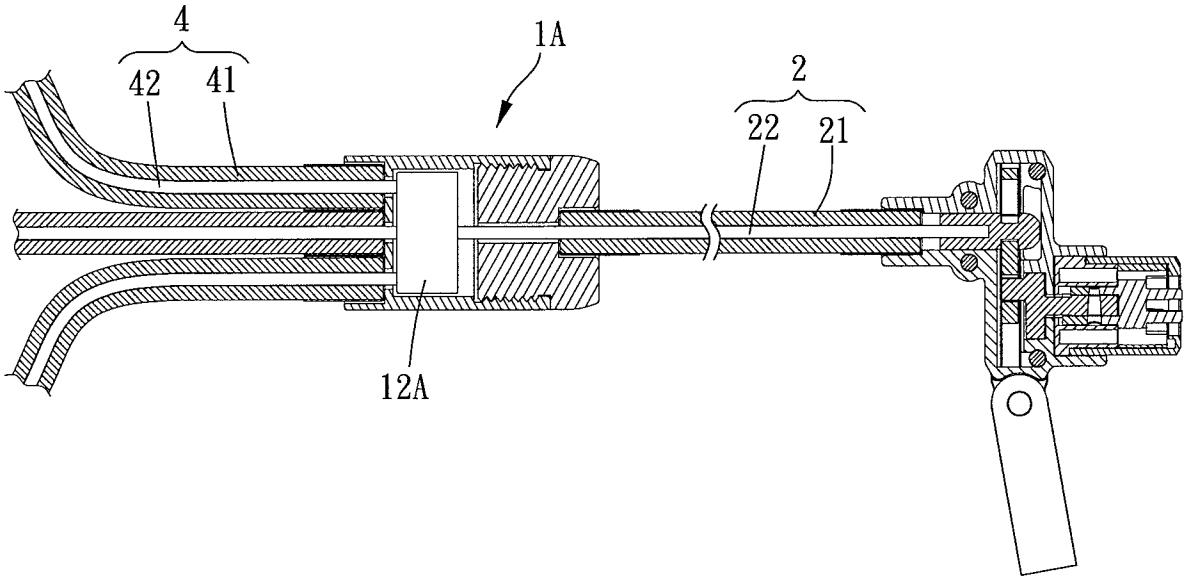
FIG. 7 is a partial cross-sectional view of the preferred embodiment of the present invention in another mode.

Each said second connecting member 4 includes a second outer tube 41 and a second cable 42 which is slidably disposed through the second outer tube 41, one of two ends of each said second outer tube 41 is disposed to one of the two ends of the outer sleeve 11 along the second direction 72, and one of two ends of each said second cable 42 is connected to one of the two ends of the adapting member 12 along the second direction 72. In this embodiment, there are two said second connecting members 4; but in other embodiments, the second connecting members 4 may be in other numbers (as shown in FIG. 7, there are three said second connecting members 4). Likewise, an adapting member 12A of an adapting assembly 1A can be assembled to the second cables 42 of the second connecting members 4.

Each said engaging structure 5 is connected to one of the two ends of one said second cable 42 along the second direction 72 and movable between an engaged position and a released position so that each said engaging structure 5, the adapting member 12 and the lock structure 3 are comovable, and each said engaging structure 5 is for being inserted in an anti-theft hole 91 of a 3C product 9 (in this embodiment, each said 3C product 9 is a laptop). When the lock structure 3 moves toward one of the first direction 71 and the second direction 72, each said engaging structure 5 can move to the engaged position or the released position to be optionally engaged with one said anti-theft hole 91 or pulled off.

Preferably, in this embodiment, the connection lock further includes a lock 6, the lock 6 is disposed on one of the two ends of the first outer tube 21 along the first direction 71, and when the lock structure 3 is on the locked position, the lock 6 optionally positions the lock structure 3. In this embodiment, the lock 6 is fixed on an object which is not movable (for example, a desk) to prevent people from moving the lock 6.

Figure 5:
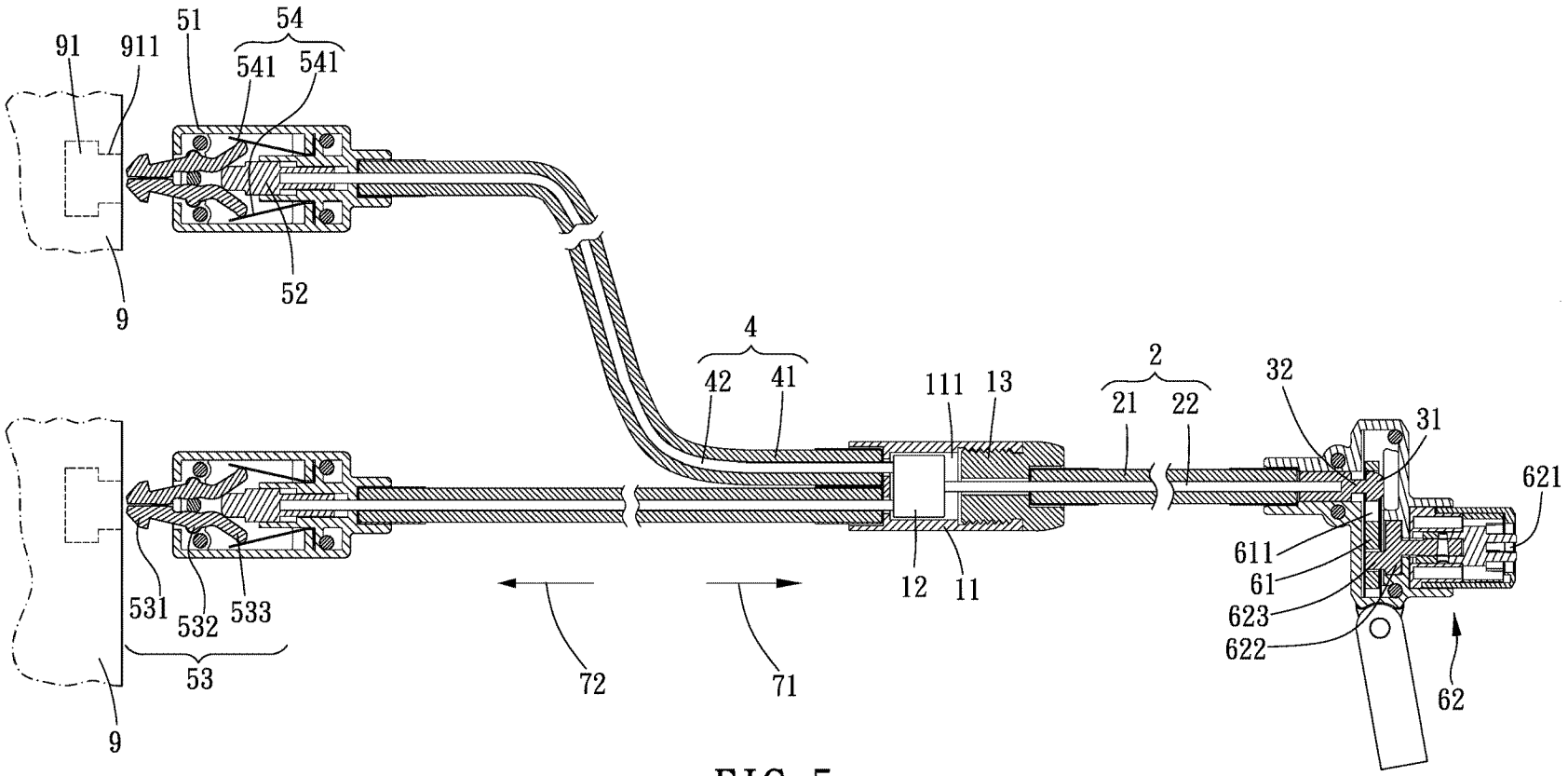
FIGS. 5 and 6 are drawings showing the preferred embodiment of the present invention in operation.
Figure 6:
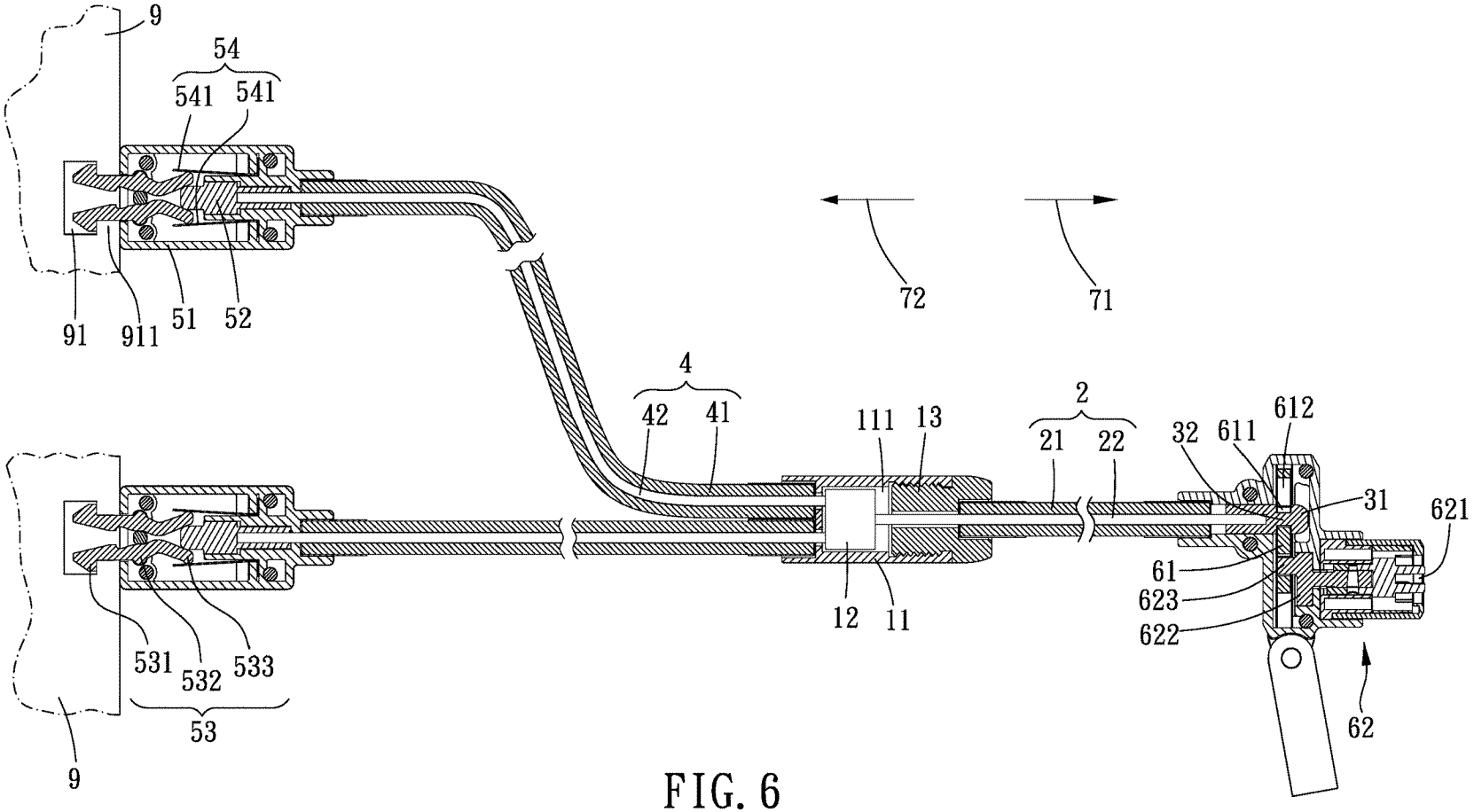

Specifically, as shown in FIGS. 5 and 6, when the lock structure moves to the locked position, the first cable 22 drives each said engaging structure 5 to move to the released position, each said engaging structure 5 is engagingly positioned by a hole edge 911 of one said anti-theft hole 91, each said engaging structure 5 cannot be detached from one said 3C product 9, and the lock 6 is fixed on the object, so the connection lock 6 can prevent the 3C products 9 from being stolen. When the lock structure 3 moves to the unlocked position, the first cable 22 drives each said engaging structure 5 to move to the engaged position, and each said engaging structure 5 is non-engaged with the hole edge 911 of one said anti-theft hole 91; therefore, each said engaging structure 5 is detached from one said 3C product 9, and each said 3C product 9 is movable, and the connection lock can correspond to a plurality of 3C products 9 to lock or unlock the 3C products 9. In addition, the connection lock has a simple structure and is easy to be operated, so it is time-saving for a user to lock or unlock the 3C products 9.

Please refer to FIGS. 1 to 4, one of the two ends of the outer sleeve 11 has a receiving space 111 along the first direction 71, and the adapting member 12 is slidably arranged in the receiving space 111. One of the two ends of the outer sleeve 11 has at least two assembling holes 112 along the second direction 72 which correspond to a number of the at least two second connecting members 4, a bottom portion of each said assembling hole 112 has a radially-narrowed hole 113 which communicates with the receiving space 111, one of two ends of each said second outer tube 41 is inserted into one said assembling hole 112, and each said second cable 42 is disposed through one said radially-narrowed hole 113 to be connected to the adapting member 12.

Preferably, the outer sleeve 11 further has a cover 13, the cover 13 covers an opening of the receiving space 111, the first outer tube 21 is inserted in the cover 13, and the first cable 22 is disposed through the cover 13 to be connected to the adapting member 12. In this embodiment, the cover 13 and the outer sleeve 11 are screwed with each other, and when the adapting member 12, the first cable 22 or the second cables 42 are broken, the user can quickly disengaged the cover 13 to maintain or replace the adapting member 12, the first cable 22 or the second cables 42 which are broken.

Specifically, each said engaging structure 5 includes a shell 51, an actuating member 52, two engaging members 53 and an elastic assembly 54, one of the two ends of each said second outer tube 41 opposite to the adapting member 12 is inserted in one said shell 51, each said actuating member 52 is slidably arranged on one said shell 51 and connected to one said second cable 42 so that the actuating member 52 and the lock structure 3 are comovable, each said actuating member 52 is movable toward the released position on the first direction 71 and toward the engaged position on the second direction 72, each said actuating member 52 is located between the two engaging members 53 and one said second cable 42, the two engaging members 53 are swingable relative to each other, the two engaging members 53 are disposed in the shell 51 for being inserted in the anti-theft hole 91 of one said 3C product 9, and each said elastic assembly 54 is disposed in the shell 51 and abuts against the two engaging members 53 normally to make engaging ends 531 of the two engaging members 53 which are remote from the second cable 42 have a tendency to move away from each other. When the lock structure 3 moves to the locked position, the second cable 42 drives each said actuating member 52 to move to the released position, each said actuating member 52 non-abuts against one of two ends of the two engaging members 53 which are near the adapting member 12, the engaging ends 531 of the two engaging members 53 move away from each other and engagingly positioned by the hole edge 911 of one said anti-theft hole 91, and each said engaging structure 5 cannot be detached from one said anti-theft hole 91; when the lock 6 does not positionably restricts the lock structure 3, each said actuating member 52 moves to the engaged position, and the lock structure 3 moves to the unlocked position, each said actuating member 52 abuts against the two engaging members 53 to make the engaging ends 531 of the two engaging members 53 move toward each other and non-abut against the hole edge 911 of one said anti-theft hole 91, and each said engaging structure 5 can be detached from one said anti-theft hole 91.

Each of the two engaging members 53 of each said engaging structure 5 further has a pivot portion 532, the two pivot portions 532 are pivoted to the shell 51, one of the two ends of each said engaging member 53 which is near the adapting member 12 has a driving end 533, and the pivot portion 532 is located between the engaging end 531 and the driving end 533. In this embodiment, each said elastic assembly 54 includes two elastic members 541, the two elastic members 541 are L-shaped, the two elastic members 541 are disposed in the shell 51, and one of two ends of the two elastic members 541 are respectively abut against the driving ends 533 of the two engaging members 53 to make the driving ends 533 of the two engaging members 53 have a tendency to move toward each other. Each said pivot portion 532 is located between the driving end 533 and the engaging end 531, so a distance between the two engaging ends 531 of each said engaging structure 5 and a distance between the two driving ends 533 are in inverse proportion.

Specifically, the lock 6 has a position-restricting member 61, the position-restricting member 61 is slidable between a third position and a fourth position, the position-restricting member 61 has a position-restricting hole 611, one of two ends of the position-restricting hole 611 has an expanded portion 612, the lock structure 3 includes a head portion 31 and a neck portion 32 which has a smaller diameter than the head portion 31 does, the expanded portion 612 is greater than the head portion 31 in radial dimension, the position-restricting hole 611 is greater than the neck portion 32 but smaller than the head portion 31 in radial dimension, when the position-restricting member 61 is on the third position, the lock structure 3 corresponds to the expanded portion 612 and is movable to be on the locked position and the unlocked position; when the position-restricting member 61 is on the fourth position, and the lock structure 3 is on the locked position, the position-restricting hole 611 is engaged with the neck portion 32 to make the lock structure 3 unmovable to be on the unlocked position. Therefore, the two engaging members 53 of the engaging structure 5 can be kept away from each other for being engaged by the hole edge 911 of the anti-theft hole 91.

The lock 6 further has a locking member 62, the locking member 62 includes a keyhole 621 and a rotating member 622, the rotating member 622 has a protrusive block 623, the position-restricting member 61 further has a slide hole 613, the protrusive block 623 is slidably inserted in the slide hole 613, and when the rotating member 622 rotates, the protrusive block 623 drives the position-restricting member 61 to slide between the third position and the fourth position. The user can insert a key into the keyhole 621 to rotate to drive the rotating member 622 to rotate so as to control the position-restricting member 61 to slide between the third position and the fourth position.

Given the above, the connection lock can correspond to a plurality of 3C products to lock or unlock the 3C products, and the connection lock has a simple structure and is easy to be operated, so it is time-saving for the user to lock or unlock the 3C products.

While we have shown and described various embodiments in accordance with the present invention, it should be clear to those skilled in the art that further embodiments may be made without departing from the scope of the present invention.

What is claimed is:

1. A connection lock, including:

an adapting assembly, defining a first direction and a second direction which is opposite to the first direction, including an outer sleeve and an adapting member which is slidably arranged in the outer sleeve;

a first connecting member, including a first outer tube and a first cable which is slidably disposed through the first outer tube, one of two ends of the first outer tube being disposed to one of two ends of the outer sleeve along the first direction, one of two ends of the first cable being connected to one of two ends of the adapting member along the first direction;

a lock structure, connected to another one of the two ends of the first cable opposite to the adapting member so that the adapting member is comovable with the lock structure, when the lock structure moves toward one of the first direction and the second direction, the lock structure is on a locked position; when the lock structure moves toward the other of the first direction and the second direction, the lock structure is on an unlocked position;

at least two second connecting members, each said second connecting member including a second outer tube and a second cable which is slidably disposed through the second outer tube, one of two ends of each said second outer tube being disposed to one of the two ends of the outer sleeve along the second direction, one of two ends of each said second cable being connected to one of the two ends of the adapting member along the second direction;

at least two engaging structures, each said engaging structure being connected to one of the two ends of one said second cable along the second direction and movable between an engaged position and a released position so that each said engaging structure, the adapting member and the lock structure are comovable, each said engaging structure for being inserted in an anti-theft hole of a 3C product;

wherein when the lock structure moves toward one of the first direction and the second direction, each said engaging structure is movable to be on the engaged position or the released position.

2. The connection lock of claim 1, wherein when the lock structure moves to the locked position, the first cable drives each said engaging structure to move to the released position, each said engaging structure is engagingly positioned by a hole edge of one said anti-theft hole; when the lock structure moves to the unlocked position, the first cable drives each said engaging structure to move to the engaged position, and each said engaging structure is non-engaged with the hole edge of one said anti-theft hole.

3. The connection lock of claim 2, wherein one of the two ends of the outer sleeve has a receiving space along the first direction, and the adapting member is slidably arranged in the receiving space.

4. The connection lock of claim 3, wherein one of the two ends of the outer sleeve has at least two assembling holes along the second direction which correspond to a number of the at least two second connecting members, a bottom portion of each said assembling hole has a radially-narrowed hole which communicates with the receiving space, one of two ends of each said second outer tube is inserted into one said assembling hole, and each said second cable is disposed through one said radially-narrowed hole to be connected to the adapting member.

5. The connection lock of claim 3, wherein the outer sleeve further has a cover, the cover covers an opening of the receiving space, the first outer tube is inserted in the cover, and the first cable is disposed through the cover to be connected to the adapting member.

6. The connection lock of claim 2, wherein each said engaging structure includes a shell, an actuating member, two engaging members and an elastic assembly, one of the two ends of each said second outer tube opposite to the adapting member is inserted in one said shell, each said actuating member is slidably arranged on one said shell and connected to one said second cable to make the actuating member and the lock structure comove with each other, each said actuating member is movable toward the released position on the first direction and toward the engaged position on the second direction, each said actuating member is located between the two engaging members and one said second cable, the two engaging members are swingable relative to each other, the two engaging members are disposed in the shell for being inserted in the anti-theft hole of one said 3C product, and each said elastic assembly is disposed in the shell and abuts against the two engaging members normally to make engaging ends of the two engaging members which are remote from the second cable have a tendency to move away from each other;

wherein when the lock structure moves to the locked position, the second cable drives each said actuating member to move to the released position, each said actuating member non-abuts against one of two ends of the two engaging members which are near the adapting member, and the engaging ends of the two engaging members move away from each other and engagingly positioned by the hole edge of one said anti-theft hole; when each said actuating member moves to the engaged position, and the lock structure moves to the unlocked position, each said actuating member abuts against the two engaging members to make the engaging ends of the two engaging members move toward each other and non-abut against the hole edge of one said anti-theft hole.

7. The connection lock of claim 6, wherein each of the two engaging members of each said engaging structure further has a pivot portion, the two pivot portions are pivoted to the shell, one of the two ends of each said engaging member which is near the adapting member has a driving end, and the pivot portion is located between the engaging end and the driving end.

8. The connection lock of claim 7, wherein each said elastic assembly includes two elastic members, the two elastic members are disposed in the shell, and one of two ends of the two elastic members respectively abut against the driving ends of the two engaging members to make the driving ends of the two engaging members have a tendency to move toward each other.

9. The connection lock of claim 1, further including a lock, the lock disposed on one of the two ends of the first outer tube along the first direction, when the lock structure is on the locked position, the lock optionally positions the lock structure.

10. The connection lock of claim 9, wherein the lock has a position-restricting member, the position-restricting member is slidable between a third position and a fourth position, the position-restricting member has a position-restricting hole and an expanded portion communicated with and wider than the position-restricting hole, the lock structure includes a head portion and a neck portion which has a smaller diameter than the head portion does, the expanded portion is greater than the head portion in radial dimension, the position-restricting hole is greater than the neck portion but smaller than the head portion in radial dimension, when the position-restricting member is on the third position, the lock structure corresponds to the expanded portion and is movable to be on the locked position and the unlocked position; when the position-restricting member is on the fourth position, and the lock structure is on the locked position, the position-restricting hole is engaged with the neck portion to make the lock structure unmovable to be on the unlocked position.

11. The connection lock of claim 10, wherein the lock further has a locking member, the locking member includes a keyhole and a rotating member, the rotating member has a protrusive block, the position-restricting member further has a slide hole, the protrusive block is slidably inserted in the slide hole, and when the rotating member rotates, the protrusive block drives the position-restricting member to slide between the third position and the fourth position.

12. The connection lock of claim 8, wherein one of the two ends of the outer sleeve has a receiving space along the first direction, and the adapting member is slidably arranged in the receiving space; one of the two ends of the outer sleeve has at least two assembling holes along the second direction which correspond to a number of the at least two second connecting members, a bottom portion of each said assembling hole has a radially-narrowed hole which communicates with the receiving space, one of two ends of each said second outer tube is inserted into one said assembling hole, and each said second cable is disposed through one said radially-narrowed hole to be connected to the adapting member; the outer sleeve further has a cover, the cover covers an opening of the receiving space, the first outer tube is inserted in the cover, and the first cable is disposed through the cover to be connected to the adapting member; the connection lock further includes a lock, the lock is disposed on one of the two ends of the first outer tube along the first direction, and when the lock structure is on the locked position, the lock optionally positions the lock structure; the lock has a position-restricting member, the position-restricting member is slidable between a third position and a fourth position, the position-restricting member has a position-restricting hole and an expanded portion communicated with and wider than the position-restricting hole, the lock structure includes a head portion and a neck portion which has a smaller diameter than the head portion does, the expanded portion is greater than the head portion in radial dimension, the position-restricting hole is greater than the neck portion but smaller than the head portion in radial dimension, when the position-restricting member is on the third position, the lock structure corresponds to the expanded portion and is movable to be on the locked position and the unlocked position; when the position-restricting member is on the fourth position, and the lock structure is on the locked position, the position-restricting hole is engaged with the neck portion to make the lock structure unmovable to be on the unlocked position; the lock further has a locking member, the locking member includes a keyhole and a rotating member, the rotating member has a protrusive block, the position-restricting member further has a slide hole, the protrusive block is slidably inserted in the slide hole, and when the rotating member rotates, the protrusive block drives the position-restricting member to slide between the third position and the fourth position.

* * * * *